US011137148B2

(12) United States Patent
Choi et al.

(10) Patent No.: US 11,137,148 B2
(45) Date of Patent: Oct. 5, 2021

(54) AIR CONDITIONER

(71) Applicant: SAMSUNG ELECTRONICS CO., LTD., Suwon-si (KR)

(72) Inventors: Sun-Muk Choi, Suwon-si (KR); Kyeong Ae Lee, Suwon-si (KR); Je Gu Lee, Seoul (KR); Dong Yoon Lee, Suwon-si (KR); Byung Woo Jeon, Seoul (KR); Kwon Jin Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 145 days.

(21) Appl. No.: 16/343,620

(22) PCT Filed: Jul. 27, 2017

(86) PCT No.: PCT/KR2017/008087
§ 371 (c)(1),
(2) Date: Apr. 19, 2019

(87) PCT Pub. No.: WO2018/074712
PCT Pub. Date: Apr. 26, 2018

(65) Prior Publication Data

US 2019/0331350 A1 Oct. 31, 2019

(30) Foreign Application Priority Data

Oct. 21, 2016 (KR) ..... 10-2016-0137920

(51) Int. Cl.
*F24F 1/0014* (2019.01)
*F24F 1/0025* (2019.01)
*F24F 13/12* (2006.01)

(52) U.S. Cl.
CPC ..... *F24F 1/0014* (2013.01); *F24F 1/0025* (2013.01); *F24F 13/12* (2013.01)

(58) Field of Classification Search
CPC ..... F24F 1/0014; F24F 1/0025; F24F 13/12; F24F 13/08; F24F 13/081; F04D 29/442; F04D 29/422; F04D 29/4226; F04D 29/46
(Continued)

(56) References Cited

U.S. PATENT DOCUMENTS

2015/0075201 A1* 3/2015 Park ..... F24F 13/12 62/262

FOREIGN PATENT DOCUMENTS

CN 101206058 6/2008
CN 101307936 11/2008
(Continued)

OTHER PUBLICATIONS

Extended European Search Report dated Aug. 23, 2019 from European Patent Application No. 17862937.4, 11 pages.
(Continued)

*Primary Examiner* — Kenneth J Hansen
*Assistant Examiner* — Ryan L Faulkner
(74) *Attorney, Agent, or Firm* — Staas & Halsey LLP

(57) ABSTRACT

An air conditioner includes a heat exchanger for exchanging heat with air introduced to an inside of a housing and a fan for blowing the air having heat exchanged by the heat exchanger to an outside of the housing, the air conditioner capable of blowing air at various airflows by controlling a door configured to selectively open a first portion and a second portion, different from the first portion, of an air outlet of the housing and controlling a guide member configured to controlling a flow path inside the housing.

11 Claims, 8 Drawing Sheets

(58) Field of Classification Search
USPC ..... 454/233, 274, 298, 324, 334
See application file for complete search history.

(56) References Cited

FOREIGN PATENT DOCUMENTS

| | | | | |
|---|---|---|---|---|
| CN | 104697060 | | 6/2015 | |
| EP | 1 188 993 | A1 | 3/2002 | |
| EP | 2 559 572 | A1 | 2/2013 | |
| EP | 2 719 958 | A2 | 4/2014 | |
| EP | 2 719 969 | A1 | 4/2014 | |
| JP | 63-147652 | | 9/1988 | |
| JP | 2008-128622 | A | 6/2008 | |
| JP | 2008-151477 | | 7/2008 | |
| KR | 10-0554285 | | 7/2005 | |
| KR | 10-2008-0101476 | A | 11/2008 | |
| KR | 10-1339940 | | 11/2008 | |
| KR | 10-2014-0018445 | | 2/2014 | |
| KR | 1020160121675 | * | 9/2016 | ..... F24F 1/00 |

OTHER PUBLICATIONS

Chinese Office Action dated Jul. 1, 2020 from Chinese Application No. 201780064762.X, 19 pages.
International Search Report dated Nov. 2, 2017 in corresponding International Application No. PCT/KR2017/008087.
Written Opinion of the International Searching Authority dated Nov. 2, 2017 in corresponding International Application No. PCT/KR2017/008087.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2017/008087 filed on Jul. 27, 2017, which claims foreign priority benefit under 35 U.S.C. § 119 of Korean Patent Application No. 10-2016-0137920 filed Oct. 21, 2016, the entire contents of both of which are incorporated herein by reference.

TECHNICAL FIELD

The present disclosure relates to an air conditioner, and more specifically, to an air conditioner capable of varying an air discharge method and controlling a flow of discharged air.

BACKGROUND ART

The present disclosure relates to an air conditioner, and more specifically, to an air conditioner In general, the air conditioner refers to a device that adjusts the temperature, humidity, airflow, distribution and the like to be suitable for human activities using a refrigeration cycle and also serves to remove dust in the air. Main components forming the refrigeration cycle include a compressor, a condenser, an evaporator, a fan, and the like.

The air conditioner may be divided into a split air conditioner in which an indoor unit and an outdoor unit are separately installed from each other and a packaged air conditioner in which an indoor unit and an outdoor unit are installed together in a single cabinet. The indoor unit of the split air conditioner includes a heat exchanger for performing heat exchange on the air suctioned into a panel, and a fan for suctioning indoor air into the panel and blowing the suctioned air into the interior.

The conventional indoor unit of the air conditioner is manufactured such that the heat exchanger is minimized and the revolutions per minute (RPM) of the fan is increased to maximize the wind velocity and the wind volume. As a result, the discharge temperature is lowered, and is discharged to the interior in a narrow and long flow path.

A user, when directly exposed to the discharge air, may feel cold and uncomfortable, and when not exposed to the discharge air, feels hot and uncomfortable.

In addition, increasing the rotating speed of the fan to achieve a high wind speed may lead to an increase of noise. In the case of a radiation air conditioner for conditioning air without using a fan, a large panel is required to ensure the same capability as that of an air conditioner using a fan. In addition, the radiation air conditioner has a low cooling speed and incurs a great amount of installation costs.

DISCLOSURE

Technical Problem

One aspect of the present disclosure provides an air conditioner having various air discharge methods.

Another aspect of the present disclosure provides an air conditioner for cooling or heating indoor space at a minimum wind speed for a user to feel pleasant.

Technical Solution

According to an aspect of the present disclosure, there is provided an air conditioner including: a housing having an air outlet; a fan configured to suction air to an inside of the housing and move the air toward the air outlet; a door configured to selectively open a first portion and a second portion different from the first portion of the air outlet; and a guide member configured to be moveable to a first position in which air discharged from the fan is guided to the first portion of the air outlet or a second position in which air discharged from the fan is guided to the second portion of the air outlet.

The guide member may be moved to the first position when the door opens the first portion of the air outlet and may be moved to the second position when the door opens the second portion of the air outlet.

The door may be arranged on the housing to be movable in a first direction and a second direction, wherein when the door is moved in the first direction, the first portion of the air outlet may be opened, and when the door is moved in the second direction, the second portion of the air outlet may be opened.

The door may include a curved surface.

The door may include a curved surface bulging toward the housing, and the curved surface may guide air from the fan to the first portion or the second portion of the air outlet.

The door may be arranged on the housing to be moveable along a curved line having a same center of curvature as a center of curvature of the curved surface.

The door may include a plurality of holes for discharging air inside the housing when the door closes the first portion and the second portion of the air outlet.

The guide member may be arranged on the housing to be rotatable on a same center of rotation as a center of rotation of the fan.

The air conditioner may further include a motor for driving the door and a gear assembly for connecting the motor to the door.

The gear assembly may include a first gear coupled to the door and a second gear coupled to the motor.

The first gear may include a curved line.

The housing may include a guide surface including a curved surface that surrounds part of the fan to form a flow path of air discharged from the fan.

The door may be configured to partly open the first portion or the second portion of the air outlet.

According to another aspect of the present disclosure, there is provided an air conditioner including: a housing having an air outlet; a fan configured to suction air to an inside of the housing and move the air toward the air outlet; a door configured to close the air outlet or selectively open a lower portion and an upper portion of the air outlet; and a plurality of holes configured to discharge air inside the housing when the door closes the air outlet.

The air outlet may be arranged at a front surface of the housing, the door may be arranged at a front side of the housing such that the lower portion of the air outlet is opened when the door is moved upward and the upper portion of the air outlet is opened when the door is moved downward.

The air conditioner may further include a guide member configured to be moveable to a first position or a second position, wherein the guide member may be moved to the first position when the door opens the lower portion of the air outlet, and may be moved to the second position when the door closes the air outlet or opens the upper portion of the air outlet.

The fan may include a cross-flow fan, wherein the guide member may be arranged on the housing to be rotatable along a circumferential direction of the fan.

The plurality of holes may be arranged on the housing or the door.

According to another aspect of the present disclosure, there is provided an air condition including: a housing having an air outlet; a fan configured to suction air to an inside of the housing and move the air toward the air outlet; a guide surface including a curved surface that surrounds part of the fan and provided on the housing, to form a flow path of air discharged from the fan; and a guide member configured to be rotatable along a circumferential direction of the fan to change a flow path of air discharged from the fan.

The guide member may be configured to be moveable to a first position in which air discharged from the fan is guided in a radial direction of the fan and a second position in which air discharged from the fan is guided in a circumferential direction of the fan.

Advantageous Effects

According to the above-described aspects of the present disclosure, the air conditioner can discharge heat-exchanged air by varying the airflow of the heat-exchanged air according to an operating environment.

The air conditioner can discharge heat-exchanged air at different wind speeds.

The air conditioner can cool or heat indoor space while preventing heat-exchanged air from being directly exposed to a user, thereby increasing the level of satisfaction of the user.

MODE FOR DISCLOSURE

Figure 1:
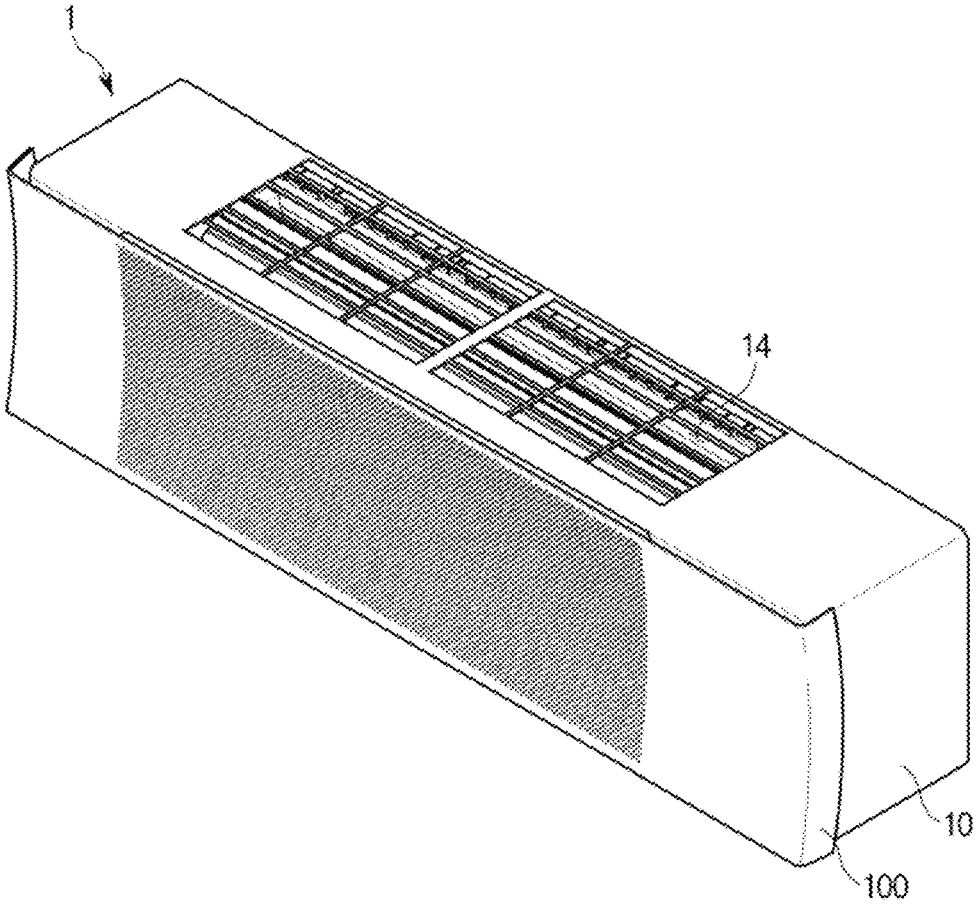
FIG. 1 is a perspective view illustrating an air conditioner according to an embodiment of the present disclosure.

Embodiments and features as described and illustrated in the disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

Hereinafter, embodiments of the present disclosure will be described in detail with reference to the accompanying drawings.

A refrigeration cycle of an Air conditioner (AC) is comprised of a compressor, a condenser, an expansion valve, and an evaporator. Refrigerants go through a series of processes of compression, condensing, expansion, and evaporation, enabling high temperature air to exchange heat with low temperature refrigerants and then the low temperature air to be supplied into the room.

A compressor compresses a gas refrigerant into a high temperature and high pressure state and discharges the compressed gas refrigerant, and the discharged gas refrigerant flows into a condenser. The condenser condenses the compressed gas refrigerant into a liquid state, releasing heat to the surroundings. An expansion valve expands the high temperature and high pressure liquid refrigerant condensed by the condenser to low pressure liquid refrigerant. The evaporator evaporates the refrigerant expanded by the expansion valve. The evaporator achieves a cooling effect using latent heat of vaporization of the refrigerant to exchange heat with an object to be cooled, and has low temperature and low pressure gas refrigerant return to the compressor. Through this cycle, the temperature of indoor air may be conditioned.

An outdoor unit of an air conditioner refers to a part comprised of the compressor and an outdoor heat exchanger of the refrigeration cycle. The expansion valve may be placed in one of the indoor or outdoor units, and the indoor heat exchanger is placed in the indoor unit of the air conditioner.

The disclosure is directed to an air conditioner for cooling indoor space, where the outdoor heat exchanger serves as the condenser while the indoor heat exchanger serves as the evaporator. Hereinafter, for convenience of explanation, an indoor unit including the indoor heat exchanger is called an air conditioner, and the indoor heat exchanger is called a heat exchanger.

Figure 2:
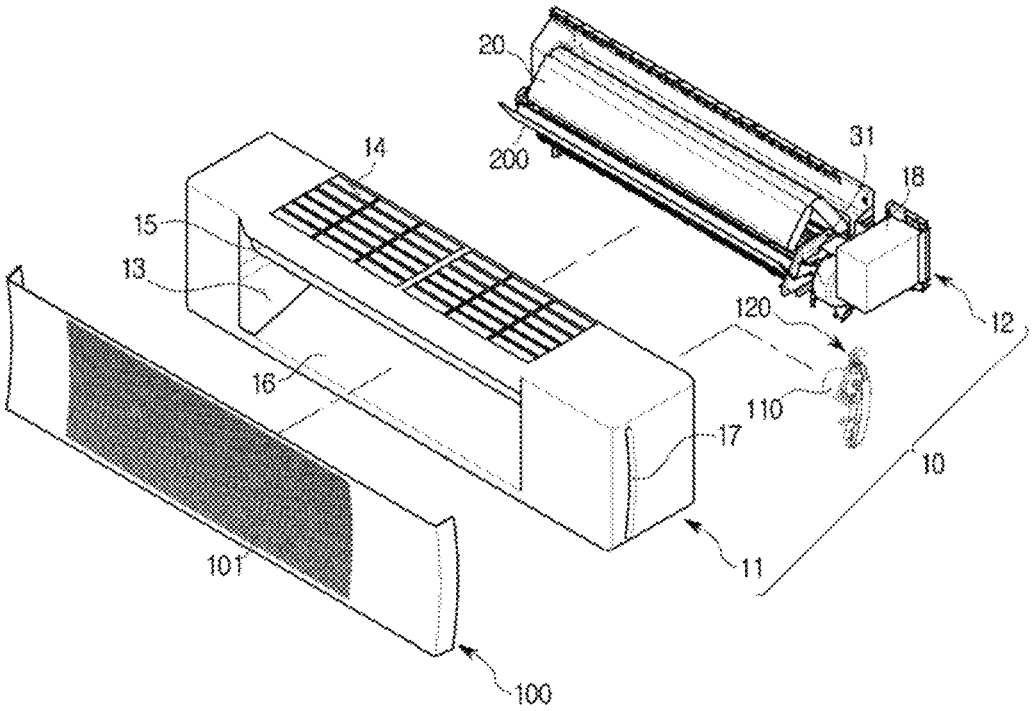
FIG. 2 is an exploded perspective view illustrating some components of the air conditioner according to the embodiment of the present disclosure.
Figure 3:
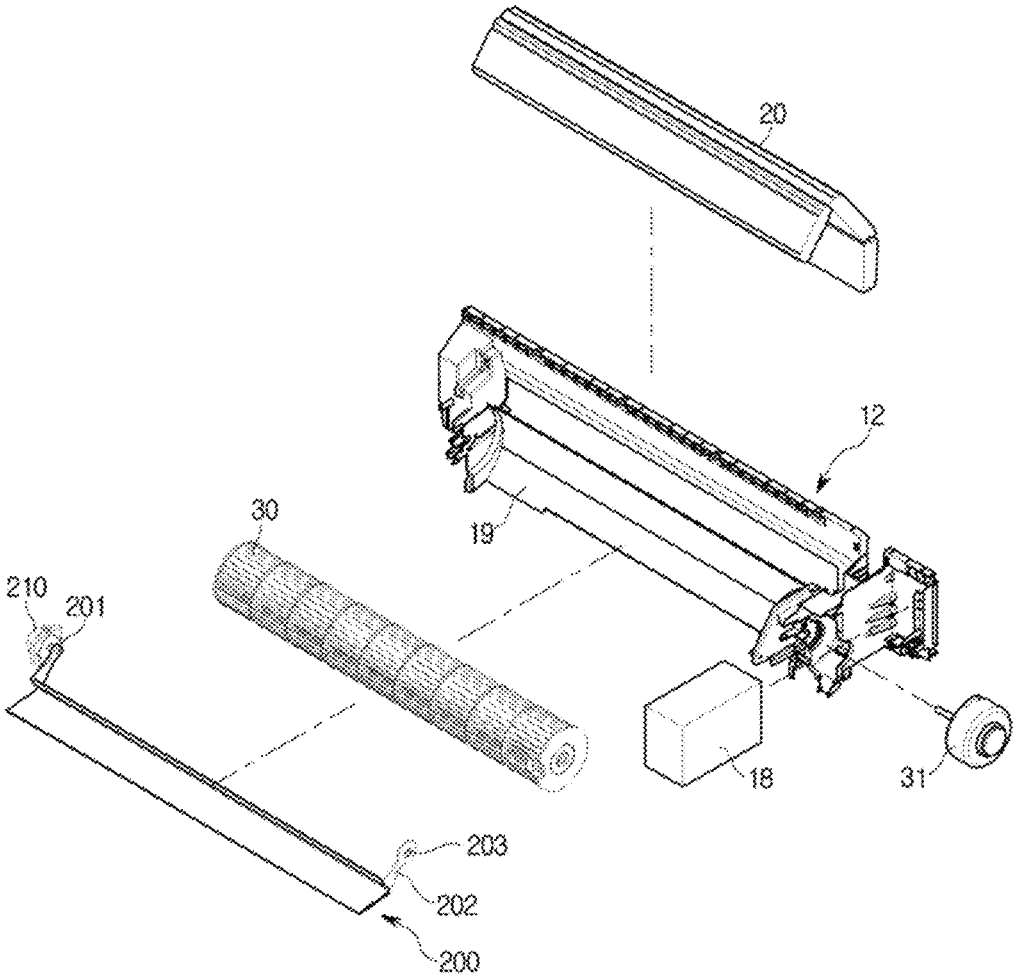
FIG. 3 is an exploded perspective view illustrating some other components of the air conditioner according to the embodiment of the present disclosure.
Figure 4:
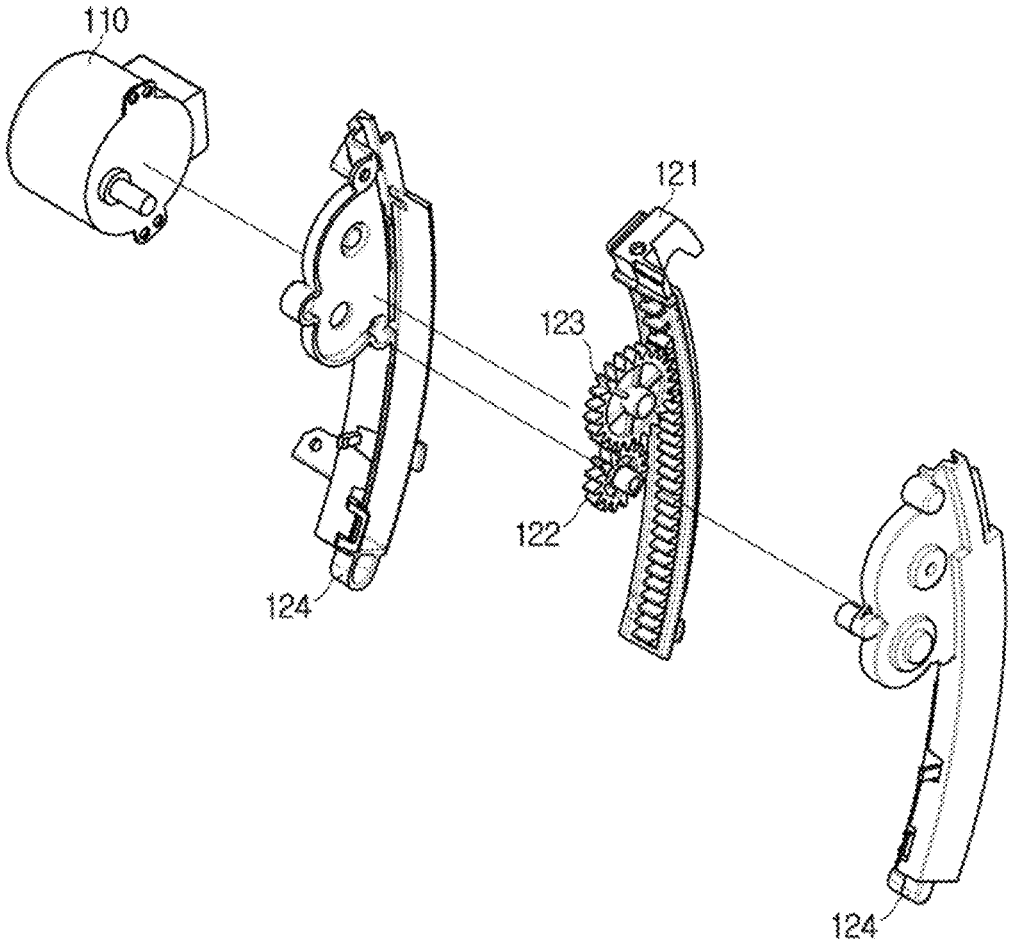
FIG. 4 is an exploded perspective view illustrating a gear assembly of the air conditioner according to the embodiment of the present disclosure.
Figure 5:
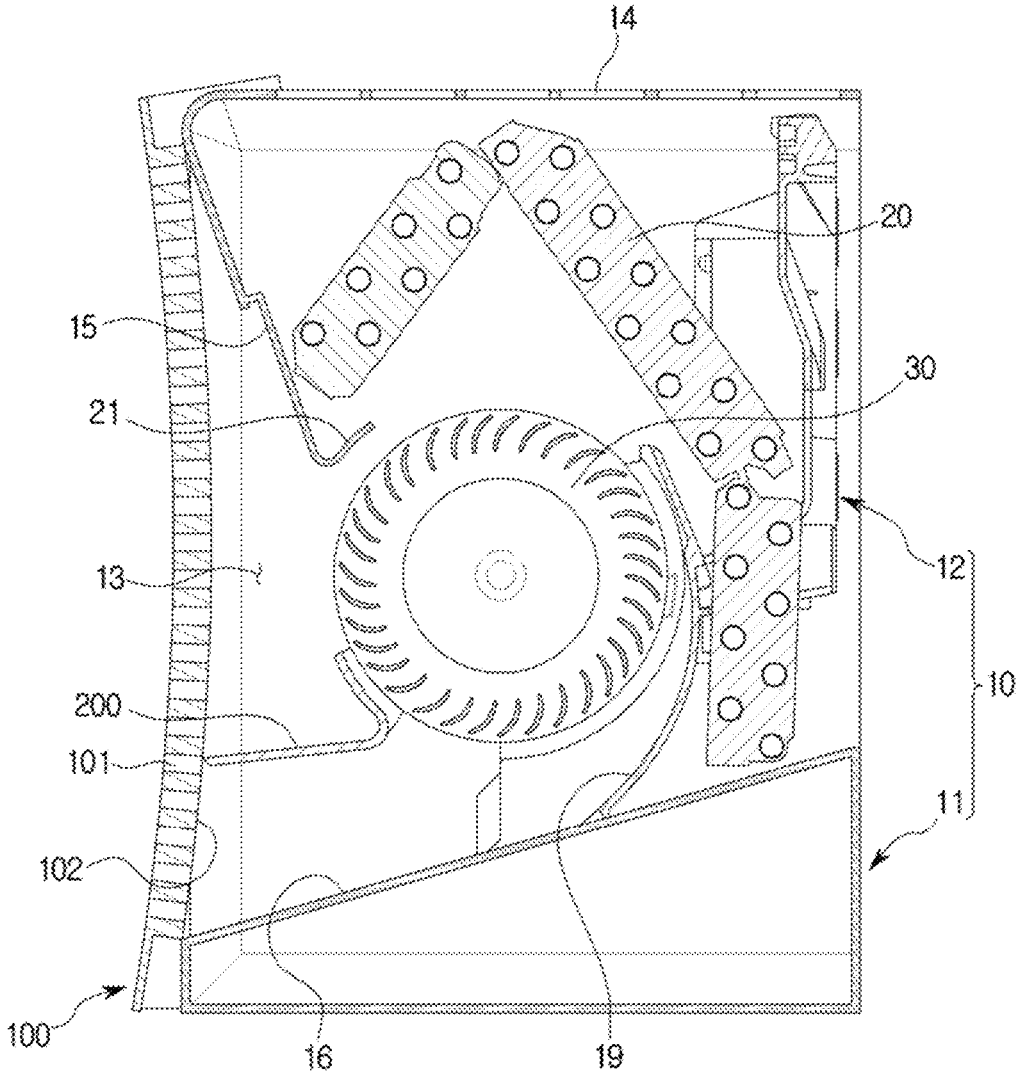
FIG. 5 is a cross-sectional view illustrating the air conditioner according to the embodiment of the present disclosure.

FIG. 1 is a perspective view illustrating an air conditioner according to an embodiment of the present disclosure, FIG. 2 is an exploded perspective view illustrating some components of the air conditioner according to the embodiment of the present disclosure, FIG. 3 is an exploded perspective view illustrating some other components of the air conditioner according to the embodiment of the present disclosure, FIG. 4 is an exploded perspective view illustrating a gear assembly of the air conditioner according to the embodiment of the present disclosure, and FIG. 5 is a cross-sectional view illustrating the air conditioner according to the embodiment of the present disclosure.

Referring to FIGS. 1 to 5, the air conditioner 1 includes a housing 10 having an air inlet 14 and an air outlet 13, a heat exchanger 20 arranged inside the housing 10 and heat-exchanging with air introduced to the inside of the housing 10, a fan 30 for suctioning air to the inside of the housing 10 and moving the suctioned air toward the air outlet 13, and a door 100 for opening and closing the air outlet 13.

The housing 10 may be provided in a rectangular parallelepiped shape having a transverse length longer than a longitudinal length, and the air outlet 13 may also be formed in a rectangular shape corresponding to the length of the housing 10. In addition, the door 100 may also be formed in a rectangular shape to correspond to the air outlet 13. The air outlet 13 may be arranged on a front surface of the housing 10, and the door 100 may be arranged in front of the housing 10 to open and close the air outlet 13.

The door 100 may be configured to selectively open a first portion of the fan 13 and a second portion of the fan 13 that is different from the first portion. The door 100 may be arranged on the housing 10 to be movable in a first direction and a second direction. The first portion of the air outlet 13 is opened when the door 100 is moved in the first direction, and the second portion of the air outlet 13 is opened when the door 100 is moved in the first direction.

Preferably, the door 100 may be arranged on the housing 10 to be movable upward and downward. The door may be configured to open a lower portion of the air outlet 13 by moving upward, and open an upper portion of the air outlet 13 by moving downward.

In addition, the door 100 includes a plurality of holes 101 for discharging air inside the housing 10 when the door 100 closes the air outlet 13, that is, when the door 100 closes both of the first portion and the second portion of the air outlet 13. The plurality of holes 101 may be provided as a circular hole, and may be formed in various shapes, such as a triangle, a square, a star, and the like.

Although not shown, the plurality of holes for discharging air inside the housing 10 when the air outlet 13 is closed by the door 100 may also be formed in at least a part of a lateral surface and/or a lower surface of the housing 10.

The air conditioner 1 may control an airflow, such as a wind direction and wind volume of the discharged air, by selectively opening and closing the first portion or the second portion of the air outlet 13 using the door 100.

The air conditioner 1 may be provided to be installed on a wall surface. The housing 10 may include a chassis 12 on which various components arranged inside the housing 10, such as the heat exchanger 20 and the fan 30, may be mounted and a cover 11 surrounding the chassis 12.

The cover 11 may be provided at an upper surface thereof with an air inlet 14 through which air is suctioned into the interior space of the housing 10. An opening may be formed in a rear surface of the cover 11 and a rear surface of the chassis 12 to suction air to the interior space of the housing 10.

The cover 11 may be provided at a front surface thereof with the air outlet 13 through which air from the fan 30 is blown to the outside of the housing 10. The air outlet 13 may have a cross-section whose area gradually increases toward the outside of the housing 10. That is, the cover 11 may include a first inclined wall 15 forming an upper surface of the air outlet 13 and a second inclined wall 16 forming a lower surface of the air outlet 13.

A control panel (not shown) may be coupled to one surface of the cover 11. The control panel may include a receiver for receiving a signal from a remote controller and a display for displaying the operation state of the air conditioner 1. The control panel may be provided at an inside thereof with a printed circuit board for operating the receiver or the display.

The heat exchanger 20 is arranged inside the housing 10 and configured to heat-exchange with air introduced into the air inlet 14. That is, the heat exchanger 20 is configured to absorb heat from air introduced through the air inlet 14 or transfer heat to air introduced through the air inlet 14.

The air inlet 14 may be formed in a rectangular shape to correspond to the length of the housing 10, and the heat exchanger 20 may have a length corresponding to a length of the air inlet 14. The heat exchanger 20 may be arranged to surround a part of the fan 30 between the air inlet 14 and the fan 30. Although not shown in the drawings, the heat exchanger may be arranged between the fan and the air outlet.

Although not shown in the drawings, a filter (not shown) may be attached to the air inlet 14 of the housing 10. The filter may filter out foreign substance, such as dust, contained in the outside air suctioned through the air inlet 14. In addition, the air conditioner 1 may further include an additional filter provided inside the housing 10 to filter out and remove foreign substance, such as dust, odor particles, and the like, contained in the air.

The fan 30 may be implemented using a cross flow fan having a shape and length corresponding to those of the housing 10. That is, the fan 30 may be arranged with a rotating shaft thereof in parallel to the air inlet 14 and the air outlet 13. The fan 30 may be rotatably mounted on the chassis 12, and may be rotated by a fan motor 31 mounted on the chassis 12. The chassis 13 may be provided with an operating portion 18 that includes a circuit board and the like configured to operate the fan motor 31 for driving the fan 30 and operate other components of the air conditioner 1.

The first inclined wall 15, arranged at the front side of the cover 11, may be provided at a rear surface thereof with a water trap 21 to collect water condensed in the heat exchanger 20, and include a drain pipe (not shown) for draining the water collected in the water trap 21.

The housing 10 may include a guide surface 19 having a curved surface that surrounds part of the fan 30 to form a flow path of air from the fan 30. The guide surface 19 may be provided on the chassis 12 and arranged at a rear side of the fan 30.

A guide member 200 for determining a blowing direction of the fan 30 may be mounted on the chassis 12. The guide member 200 is referred to as a stabilizer. The guide member 200 may be formed to surround part of the fan 30 at a predetermined interval from the fan 30 to divide a suctioned air flow path and a discharged air flow path of the fan 30, and may be formed to determine the position and intensity of a vortex of the discharged air. The guide member 200 and the guide surface 19 may form the discharged air flow path of the fan 30.

The guide member 200 may be configured to be rotatable along a circumferential direction of the fan 30 to change the flow path of air discharged from the fan 30. That is, the guide member 200 may be arranged in the housing 10 to be rotatable on the same center of rotation as that of the fan 30.

The guide member 200 may be configured to be movable between a first position in which air from the fan 30 is guided to the first portion of the air outlet 13 and a second position in which air from the fan 30 is guided to the second portion of the air outlet 30.

The chassis 12 may have a first motor 210 for driving the guide member 200. The guide member 200 is provided at one side thereof with a first motor connector 201 and at the other side thereof with a fan motor connector 202. The first motor connector 201 of the guide member 200 is connected to a driving shaft of the first motor 210 mounted on the chassis 12, and the fan motor connector 202 of the guide member 200 is connected to a driving shaft of the fan motor 31 mounted on the chassis 12.

The first motor 210 and the fan motor 31 may be arranged to face each other with the guide member 200 and the fan 30 interposed therebetween. The first motor 210 may be arranged with a driving axis line aligned with that of the fan motor 31, and configured to rotate the guide member 200. The guide member 200 may include a bearing 203 provided on the fan motor connector 202 not to be rotated by the fan motor 31.

Although not shown in the drawings, a guide blade may be provided to be rotatable by a manual operation of a user. The guide blade may include a handle that may be manually rotated.

The door 100 may include a curved surface 102. Preferably, the door 100 may include a curved surface 102 bulging toward the housing 10. The curved surface 102 of the door 100 may be configured to guide air from the fan 30 to the first portion or the second portion of the air outlet 13.

The door 100 may be arranged in the housing 10 to be movable along a curved line having the same center of curvature as that of the center of curvature of the curved surface 102. The door 100, while moving along an extension of the curved surface 102, moves in a first direction to open the first portion of the air outlet 13 or moves in a second direction to open the second portion of the air outlet 13, to guide air from the fan 30 to the first portion of the air outlet 13 or to the second portion of the air outlet 13.

The air conditioner 1 may include a second motor 110 for driving the door 100 and a gear assembly 120 for connecting the second motor 110 to the door 100. The second motor 110 and the gear assembly 120 may be arranged on an inner surface of the housing 10, that is, on an inner surface of the cover 11. The cover 11 may be provided with a slit 17 for connection between the gear assembly 120 and the door 100. The door 100 has one side thereof connected to the gear assembly 120 and the second motor 110, and the other side thereof having a rail (103 in FIG. 6) for guiding movement of the door 100. Although not shown in the drawings, the second motor 110 and the gear assembly 120 may be arranged on each lateral side surface of the housing 10.

The gear assembly 120 includes a gear housing 124, a first gear 121 coupled to the door 100, a second gear 122 coupled to the second motor 110, and a third gear 123 connecting the first gear 121 to the second gear 122. The first gear 121 may be provided as a rack, and the third gear 123 may be provided as a pinion. The first gear 121 may include a curved line having the same curvature as that of the curved surface 102 of the door 100 such that the door 100 moves along the extension of the curved surface 102.

The air conditioner 1 according to the embodiment of the present disclosure may variously set and control the airflow, such as a wind direction or wind volume, through the door 100 and the guide member 200.

Figure 6:
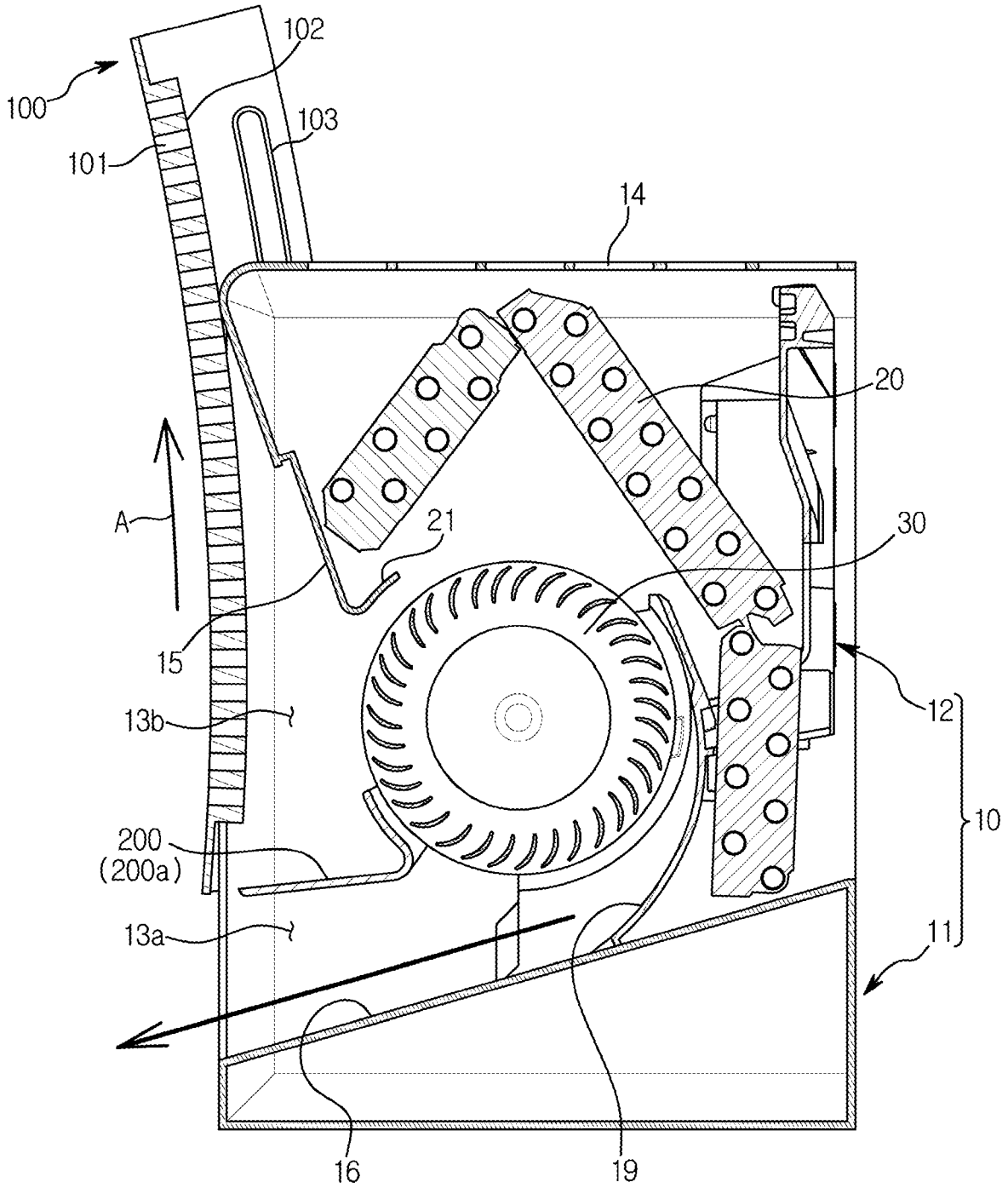
FIG. 6 is a cross-sectional view illustrating a downward wind mode of the air conditioner according to the embodiment of the present disclosure.
Figure 7:
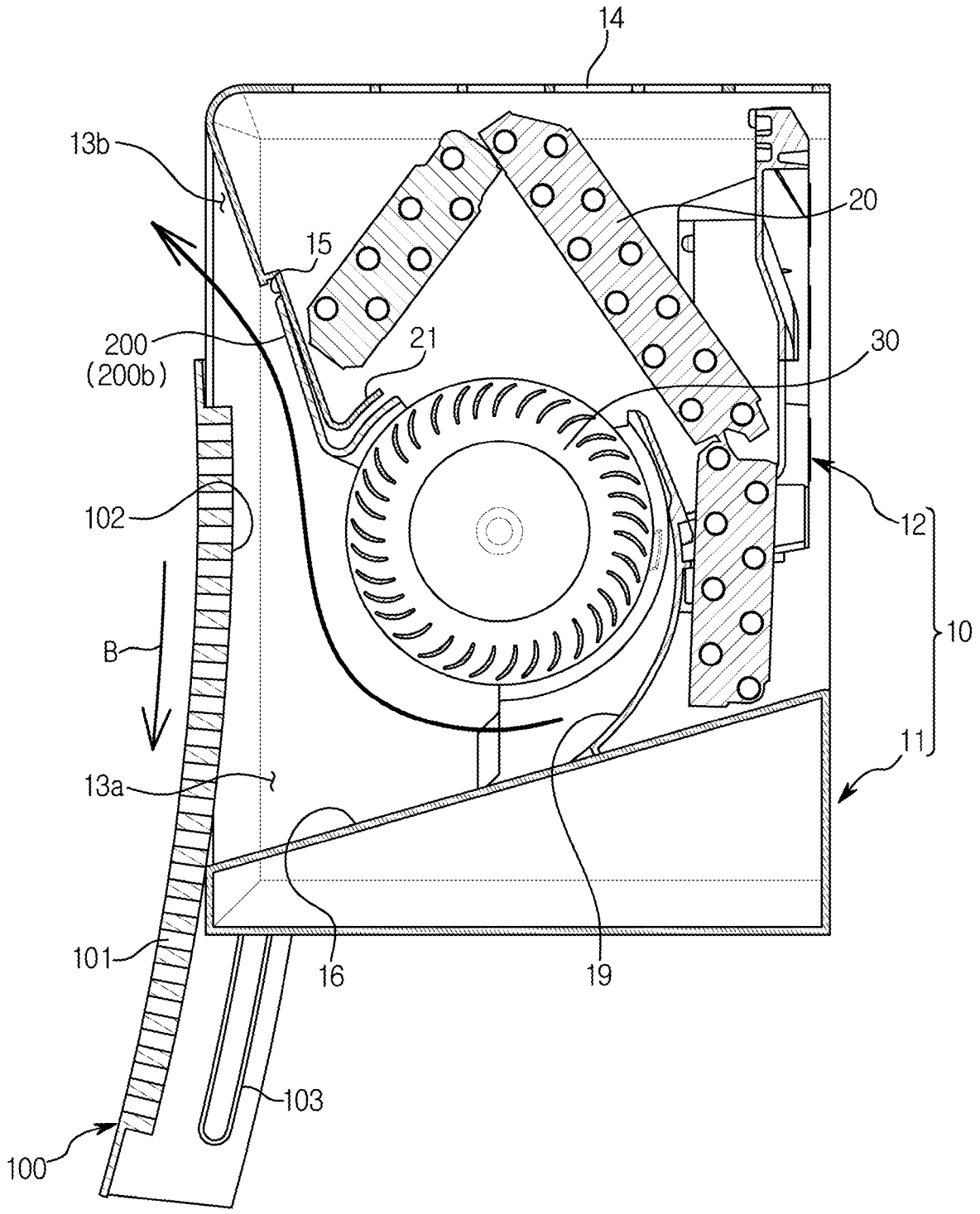
FIG. 7 is a cross-sectional view illustrating an upward wind mode of the air conditioner according to the embodiment of the present disclosure.
Figure 8:
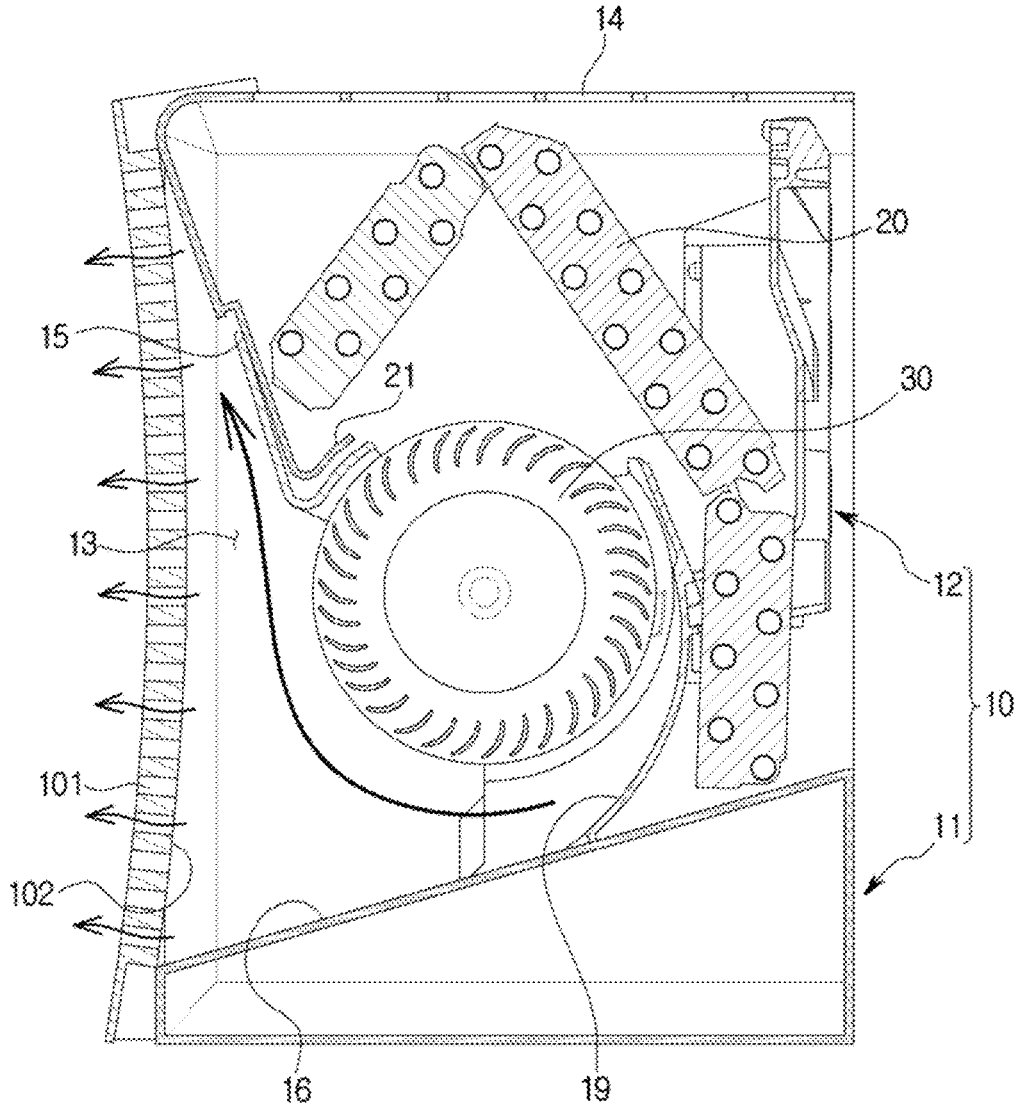
FIG. 8 is a cross-sectional view illustrating a still-air mode of the air conditioner according to the embodiment of the present disclosure.

FIG. 6 is a cross-sectional view illustrating a downward wind mode of the air conditioner according to the embodiment of the present disclosure, FIG. 7 is a cross-sectional view illustrating an upward wind mode of the air conditioner according to the embodiment of the present disclosure, and FIG. 8 is a cross-sectional view illustrating a still-air mode of the air conditioner according to the embodiment of the present disclosure.

Referring to FIG. 6, the door 100 may move in a first direction A to open a first portion 13*a* of the air outlet 13 with a second portion 13*b* of the air outlet 13 closed. In other words, the door 100 may open a lower portion 13*a* of the air outlet 13 with an upper portion 13*b* of the air outlet 13 closed, by moving in the first direction A. When the air conditioner 1 is operated with the lower portion 13*a* of the air outlet 13 opened, wind is discharged with an airflow having a higher wind speed and a wind direction oriented in the front and rear side directions.

The air conditioner 1 according to the present disclosure may be installed on a wall surface, and under the assumption that the air conditioner 1 is installed on an upper portion of a wall surface, an operating mode in which the air conditioner 1 operates with the lower portion 13*a* of the air outlet 13 opened may be defined as a downward wind mode or a direct wind mode. The direct wind mode provides a user with an instantaneous cooling or heating, and allows the interior to be rapidly air conditioned with a high wind speed and a great wind volume.

In the downward wind mode, the guide member 200 may be located in a first position 200*a* in which air from the fan 30 is guided to a first flow path directed toward the first portion 13*a* of the air outlet 13. That is, when the door 100 is moved upward to open the first portion 13*a* of the air outlet 13, the guide member 200 may be moved to the first position 200*a*.

The guide member 200 in the first position 200*a* may guide air from the fan 30 in a radial direction of the fan 30. That is, the guide member 200 in the first position 200*a* may guide air from the fan 300 to be moved along a tangent line of the fan 30 together with the second inclined wall 16 of the cover 11.

The door 100 may partly open the first portion 13*a* of the air outlet 13. That is, the air conditioner 1 may control an opening area of the upper portion 13*b* of the air outlet 13 by adjusting the displacement of the door 100.

Referring to FIG. 7, the door 100 may move in a second direction B to open the second portion 13*b* of the air outlet 13 with the first portion 13*a* of the air outlet 13 closed. In other words, the door 100 may open an upper portion 13*b* of the air outlet 13 with a lower portion 13*a* of the air outlet 13 closed, by moving downward. When the air conditioner 1 is operated with the upper portion 13*b* of the air outlet 13 opened, wind is discharged with an airflow having a higher wind speed and a wind direction oriented in the front and upper side directions.

The air conditioner 1 according to the present disclosure may be installed on a wall surface, and under the assumption that the air conditioner 1 is installed on an upper portion of a wall surface, an operating mode in which the air conditioner 1 operates with the second air outlet 210 opened may be defined as an upward wind mode or an indirect wind mode. The indirect wind mode prevents wind from being directly delivered to a user, allows the interior to be cooled by convection, and allows the interior to be rapidly air conditioned with a high wind speed and a great wind volume.

In the upward wind mode, the guide member 200 may be located in a second position 200*b* in which air from the fan 30 is guided to a second flow path directed toward the second portion 13*b* of the air outlet 13. That is, when the door 100 is moved upward to open the second portion 13*b* of the air outlet 13, the guide member 200 may be moved to the second position 200*b*.

The guide member 200 in the second position 200*b* may guide air from the fan 30 in a circumferential direction of the fan 30. That is, the guide member 200 in the second position 200*b* may guide air from the fan 300 to be moved along a periphery of the fan 30 together with the curved surface 102 of the door 100.

The door 100 may partly open the second portion 13*b* of the air outlet 13. That is, the air conditioner 1 may control an opening area of the lower portion 13*a* of the air outlet 13 by adjusting the displacement of the door 100.

The air conditioner 1 according to the present disclosure may visualize the direction of discharged airflow through the up and down movement of the door 100 so that users may be intuitively identified of the wind direction. In addition, the user may be intuitively identified of the airflow information, such as wind volume or wind speed, from the up and down movement displacement of the door 100.

Referring to FIG. 8, the guide member 200 may be moved to the second position 200*b* in a state in which the air outlet 13 is closed by the door 100. A plurality of holes 101 may be uniformly distributed on the door 100. When the guide member 200 is moved to the second position 200*b* in a state in which the air outlet 13 is closed by the door 100, air from the fan 30 may be discharged to the outside of the housing 10 through the plurality of holes 101 formed through the door 100.

When the air conditioner 1 is operated with the air outlet 13 closed, wind is discharged with an airflow having a lower wind speed and a wind direction oriented in all directions. An operating mode in which the air conditioner 1 operates with the air outlet 13 closed is defined as a still-air mode. The still-air mode allows the interior to be slowly air-conditioned as a whole while preventing wind from being directly delivered to a user.

In the downward wind mode, the lower portion 13*a* of the air outlet 13 is opened, so that air from the fan 30 forms a strong airflow toward the lower portion 13*a* of the air outlet 13. Accordingly, the amount of air from the fan 30 discharged through the plurality of holes 101 in the door 100 is zero or extremely small.

In the upward wind mode, the upper portion 13*b* of the air outlet 13 is opened, so that air from the fan 30 forms a strong airflow toward the upper portion 13*b* of the air outlet 13. Accordingly, the amount of air from the fan 30 discharged through the plurality of holes 101 in the door 100 is zero or extremely small.

In the still-air mode, the air outlet does not have any portion thereof open, so that air from the fan 30 may be discharged to the outside of the housing 10 through the plurality of holes 101 formed in the door 100 at a low speed as a whole.

The plurality of holes for the still-air mode operation may be formed not only in the door 100 but also in the housing 10. The plurality of holes 101 may have the same diameter, and in this case, the aesthetics may be improved since the plurality of holes seen in the external appearance all have the same diameter.

Meanwhile, the plurality of holes 101 may have different diameters. Preferably, a hole arranged at a portion in which air from the fan 30 has a higher flow rate is formed to have a smaller diameter, and a hole arranged at a portion in which air from the fan 30 has a lower airflow is formed to have a larger diameter. By varying the diameters of the holes, the air conditioner 1 may allow air to be discharged at the same flow rate through all the holes.

The scope of the disclosure is not limited to the aforementioned embodiments. It will be understood by those skilled in the art that various changes in form and details may be made therein without departing from the spirit and scope of the disclosure as defined by the appended claims and their equivalents.

The invention claimed is:

1. An air conditioner comprising: a housing having an air outlet; a fan configured to suction air to an inside of the housing and move the air toward the air outlet; a door configured to selectively open a first portion and a second portion different from the first portion of the air outlet; and a guide member configured to be moveable to a first position in which air discharged from the fan is guided to the first portion of the air outlet or a second position in which air discharged from the fan is guided to the second portion of the air outlet, the guide member configured to be rotatable along a circumferential direction around an axis of rotation of the fan, to change the flow path of air discharged from the fan, wherein the door includes a plurality of holes configured to discharge air at the inside of the housing with an airflow having a lower wind speed when the door closes the first portion and the second portion of the air outlet, and configured to discharge air at the inside of the housing with the airflow having a strong wind speed when the door opens the first portion or the second portion of the air outlet.

2. The air conditioner of claim 1, wherein the guide member is moved to the first position when the door opens the first portion of the air outlet and is moved to the second position when the door opens the second portion of the air outlet.

3. The air conditioner of claim 1, wherein the door is arranged on the housing to be movable in a first direction and a second direction, wherein when the door is moved in the first direction, the first portion of the air outlet is opened, and when the door is moved in the second direction, the second portion of the air outlet is opened.

4. The air conditioner of claim 1, wherein the door includes a curved surface.

5. The air conditioner of claim 4, wherein the door includes a curved surface bulging toward the housing, and the curved surface guides air discharged from the fan to the first portion or the second portion of the air outlet.

6. The air conditioner of claim 4, wherein the door is arranged on the housing to be moveable along a curved line having a same center of curvature as a center of curvature of the curved surface.

7. The air conditioner of claim 1, further comprising a motor for driving the door and a gear assembly for connecting the motor to the door.

8. The air conditioner of claim 7, wherein the gear assembly includes a first gear coupled to the door and a second gear coupled to the motor.

9. The air conditioner of claim 8, wherein the first gear includes a curved line.

10. The air conditioner of claim 1, wherein the housing includes a guide surface including a curved surface that surrounds part of the fan to form a flow path of air discharged from the fan.

11. The air conditioner of claim 1, wherein the door is configured to partly open the first portion or the second portion of the air outlet.

* * * * *